US010637164B2

(12) United States Patent
Garcia Pichardo

(10) Patent No.: US 10,637,164 B2
(45) Date of Patent: Apr. 28, 2020

(54) BONDING CONNECTORS

(71) Applicant: Hubbell Incorporated, Shelton, CT (US)

(72) Inventor: Jose Jafet Garcia Pichardo, Col Santa Ana Tlapaltitlan (MX)

(73) Assignee: HUBBELL INCORPORATED, Shelton, CT (US)

( * ) Notice: Subject to any disclaimer, the term of this patent is extended or adjusted under 35 U.S.C. 154(b) by 0 days.

(21) Appl. No.: 15/920,069

(22) Filed: Mar. 13, 2018

(65) Prior Publication Data

US 2018/0269599 A1 Sep. 20, 2018

Related U.S. Application Data

(60) Provisional application No. 62/472,038, filed on Mar. 16, 2017.

(51) Int. Cl.

| | |
|---|---|
| ***H01R 4/66*** | (2006.01) |
| ***H01R 4/42*** | (2006.01) |
| ***H01R 4/60*** | (2006.01) |
| ***H01R 4/2407*** | (2018.01) |
| ***H01R 4/2408*** | (2018.01) |
| ***H01R 11/05*** | (2006.01) |
| *H01R 4/64* | (2006.01) |

(52) U.S. Cl.

CPC ..... *H01R 4/42* (2013.01); *H01R 4/2407* (2018.01); *H01R 4/2408* (2013.01); *H01R 4/60* (2013.01); *H01R 11/05* (2013.01); *H01R 4/643* (2013.01)

(58) Field of Classification Search

CPC ..... H01R 13/648; H01R 13/3485
USPC ..... 439/92, 96, 792, 803
See application file for complete search history.

(56) References Cited

U.S. PATENT DOCUMENTS

| | | | |
|---|---|---|---|
| 2,632,068 | A | 8/1950 | Froebel et al. |
| 3,268,853 | A | 8/1966 | Noker et al. |
| 3,425,028 | A | 1/1969 | Neaderland |
| 3,594,703 | A | 7/1971 | Holtzapple |
| 4,327,887 | A | 5/1982 | Kumakura |
| 4,355,852 | A | 10/1982 | Bachle |
| 4,384,753 | A | 5/1983 | Mixon, Jr. |
| 4,784,621 | A | 11/1988 | Auclair |
| 4,884,976 | A | 12/1989 | Franks, Jr. |
| 5,041,012 | A | 8/1991 | Caprio |
| 5,094,622 | A | 3/1992 | Auclair |
| 5,240,423 | A | 8/1993 | Morrison |
| 5,928,006 | A | 7/1999 | Franks, Jr. |
| 6,045,414 | A | 4/2000 | DeFrance |
| 6,494,726 | B1 | 12/2002 | Auclair |

(Continued)

FOREIGN PATENT DOCUMENTS

WO 2009094320 6/2009

OTHER PUBLICATIONS

O-Z Gedney Grounding Fittings Catalog MA1-MA9, Nov. 2005.

(Continued)

*Primary Examiner* — Phuong K Dinh
(74) *Attorney, Agent, or Firm* — Wissing Miller LLP

(57) ABSTRACT

The present disclosure provides descriptions of bonding connectors used to connect electrical conductors to metal structures. The bonding connector includes an electrically conductive body and an electrically conductive cap that can be releasably secured to the body using a fastener assembly.

24 Claims, 8 Drawing Sheets

(56) References Cited

U.S. PATENT DOCUMENTS

| | | | | |
|---|---|---|---|---|
| 7,566,250 | B1 | 7/2009 | Good | |
| 7,670,153 | B2 | 3/2010 | Kulig | |
| 7,735,270 | B2 | 6/2010 | Olle et al. | |
| 7,946,862 | B2 | 5/2011 | Schluter | |
| 7,971,838 | B2 | 7/2011 | Osborn et al. | |
| 8,025,508 | B2 | 9/2011 | Parker et al. | |
| 9,196,978 | B2 | 11/2015 | Magno | |
| D745,846 | S | 12/2015 | Sweeney | |
| 9,287,673 | B2 * | 3/2016 | Galla | H01R 43/01 |
| 2009/0068873 | A1 | 3/2009 | Kulig | |
| 2012/0222718 | A1 | 9/2012 | Sweeney | |
| 2014/0329420 | A1 | 11/2014 | Magno | |

OTHER PUBLICATIONS

Erico Solar Bonding Lugs Internet Printout 2010 (2 pages).
O-Z Gedney Ground Fittings, Dec. 2007 (5 pages).
Cable Tray Ground Clamp Grouping Fittings Catalog, Nov. 2005.
Ilsco SGB4 and SGB5 Installation Instructions, Jan. 2013.

* cited by examiner

BONDING CONNECTORS

CROSS REFERENCE TO RELATED APPLICATIONS

The present disclosure is based on and claims benefit from co-pending U.S. Provisional Application Ser. No. 62/472,038 filed Mar. 16, 2017 entitled "Bonding Connectors" the entire contents of which are incorporated herein by reference.

BACKGROUND

Field

The present disclosure relates generally to bonding connectors, and more particularly to bonding connectors used to secure electrical conductors to metallic structures.

Description of the Related Art

To ensure safety from an electrical perspective, certain metallic structures in certain environments are often required by national or local electrical codes to be electrically bonded. Electrically bonding is used here in the technical sense to mean forming an electrically conductive path between the metallic structures and electrical ground to ensure electrical continuity between the metallic structures and ground sufficient to safely conduct any electrical current imposed on the structures to electrical ground.

A common practice in the industry to electrically bond metal structures is to attach a grounding connector to the metal structures by drilling holes in the metal structures and attaching a connector to the metal structure with a bolt passed through the hole and a nut. Another common practice in the industry is to attach a grounding connector to the metal structures by welding the connector to the metal structures. A grounding conductor, e.g., a wire, used to provide the conductive path to ground can then be attached to the connectors. However, employing such common practices requires the use of tools or other equipment, such as drills or welding devices, to attach the connector to the metal structure which is often time consuming and increases the cost to bond the metal structure.

SUMMARY

The present disclosure provides descriptions of embodiments for bonding connectors or clamps used to bond metal structures, such as for example plates, frames and like metal structures. In one exemplary embodiment, a bonding connector includes an electrically conductive body and an electrically conductive cap. The electrically conductive body includes an upper wall and a lower wall connected to the upper wall by a side wall so as to form a channel between the upper wall and the lower wall. A fastener receiving member extends from the body and is configured to receive a mounting fastener. The upper wall has a first contacting surface facing the lower wall, and the lower wall has a second contacting surface facing the upper wall. The electrically conductive cap can be releasably attached to the body and includes a conductor receiving channel and an aperture through which the fastener receiving member can pass.

BRIEF DESCRIPTION OF THE DRAWINGS

The figures depict embodiments for purposes of illustration only. One skilled in the art will readily recognize from the following description that alternative embodiments of the structures illustrated herein may be employed without departing from the principles described herein, wherein.

DETAILED DESCRIPTION

Figure 1:
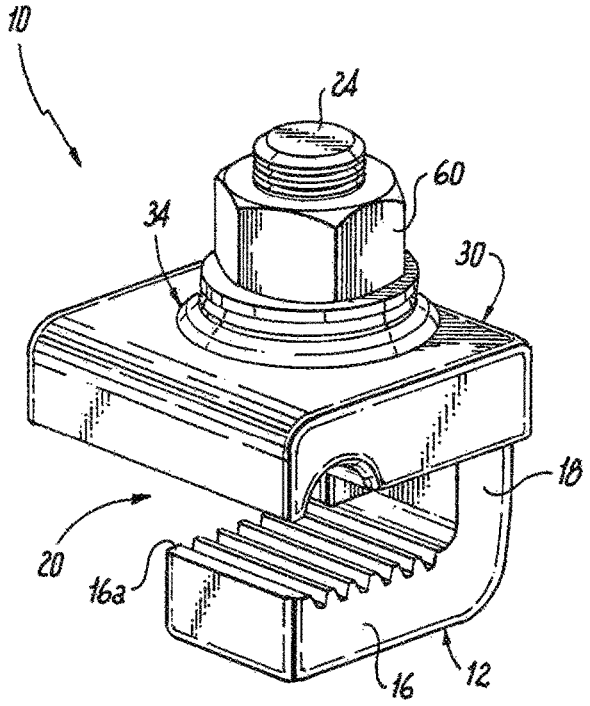
FIG. 1 is a top perspective view of an exemplary embodiment of a bonding connector according to the present disclosure.
Figure 2:
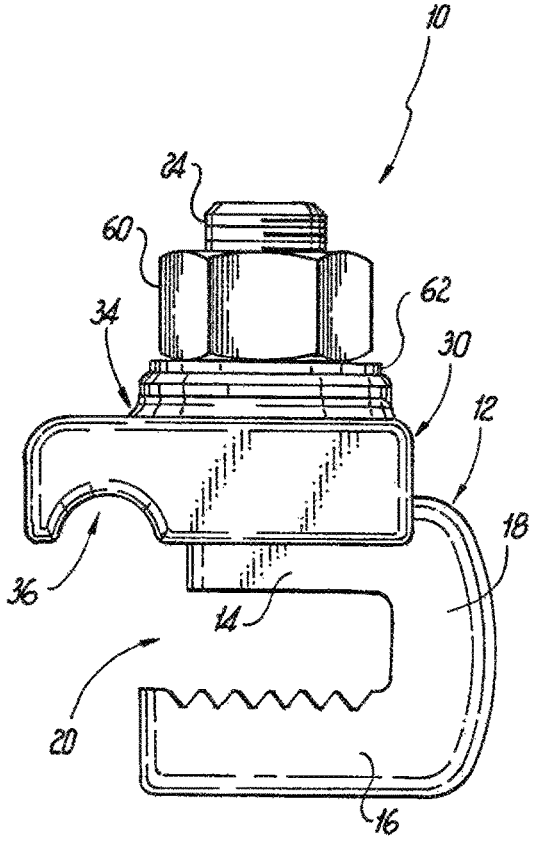
FIG. 2 is a side elevation view of the bonding connector of FIG. 1.
Figure 3:
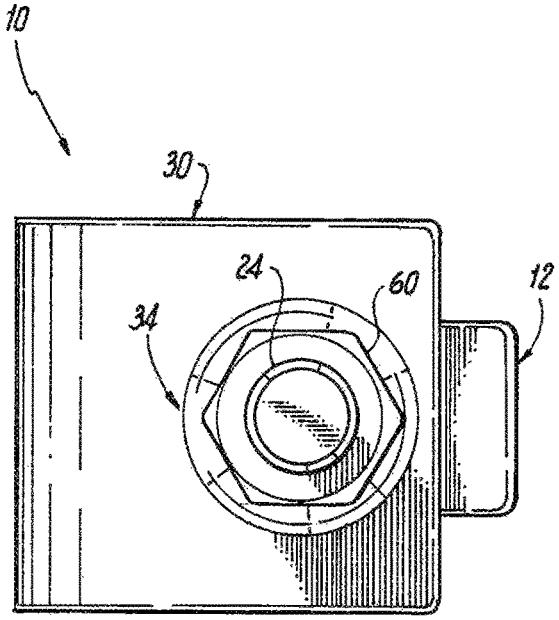
FIG. 3 is a top plan view of the bonding connector of FIG. 1.
Figure 4:
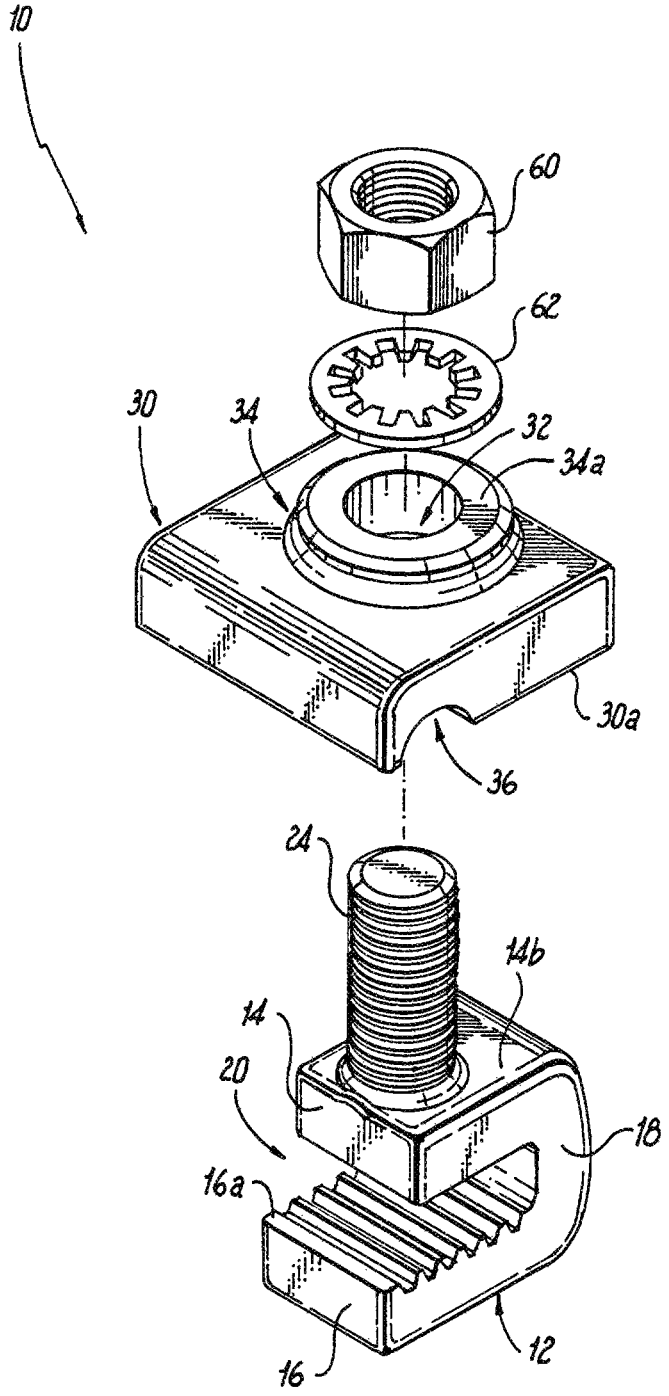
FIG. 4 is a top perspective view with parts separated of the bonding connector of FIG. 1.

The present disclosure provides descriptions of embodiments for bonding connectors used to connect electrical conductors to metal structures. Non-limiting examples of metal structures include frames, enclosures, plates, and bars. The term "connector" is used herein in a generic sense to include connectors, clamps and other devices that can connect electrical conductors to metal structures. This specification and the accompanying drawings are to be regarded in an illustrative sense rather than a restrictive sense. Various modifications may be made thereto without departing from the spirit and scope of the present disclosure.

Referring to FIGS. 1-4, an exemplary embodiment of a bonding connector according to the present disclosure is shown. In this exemplary embodiment, the bonding connector 10 includes an electrically conductive body 12 and an electrically conductive cap 30. The body is releasably secured to the cap using a fastener assembly. In the exemplary embodiment shown the fastener assembly includes a mounting fastener, such as nut 60 and washer 62, that can be attached to a fastener receiving member, such as a threaded post 24 extending from the body 12, as described below. When an electrical conductor 70, seen in FIGS. 14-16, and metal structure 80 are mated with the bonding connector 10 and the nut 60 is tightened to the post 24, the compression force exerted by the nut 60 tightening to the post 24 securely attaches the conductor 70 and metal structure 80 to the bonding connector 10. Using the nut 60 and bolt or post 24 configuration, a lightweight drive ratchet and corresponding socket, wrench or tongue and groove pliers can be used to tighten the nut 60 to the bolt or post 24, eliminating the need to use expensive, heavy and cumbersome power tools to attach a bonding connector to a conductor and metal structure.

Figure 5:
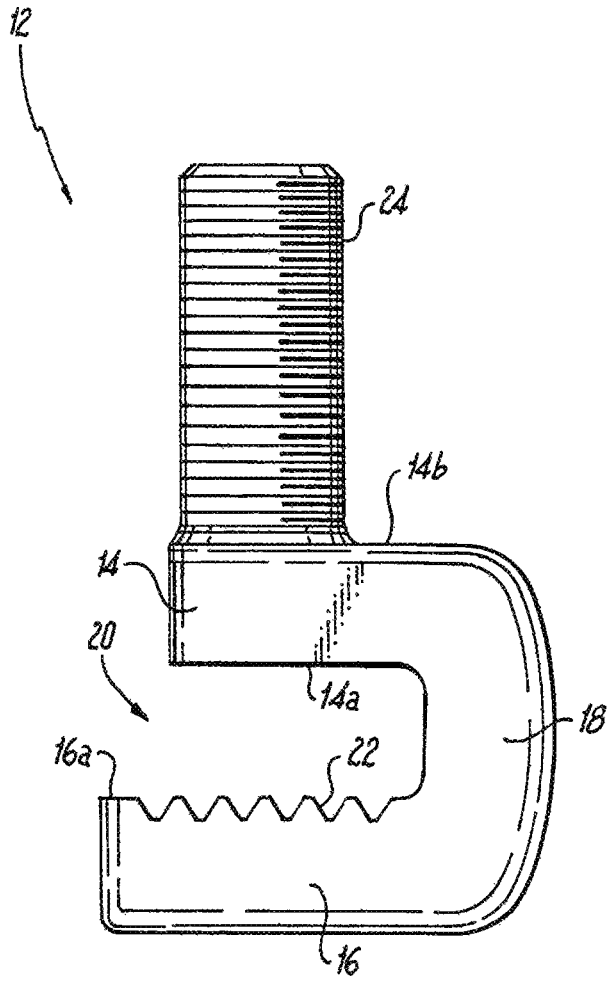
FIG. 5 is a side elevation view of a body of the bonding connector of FIG. 1.
Figure 6:
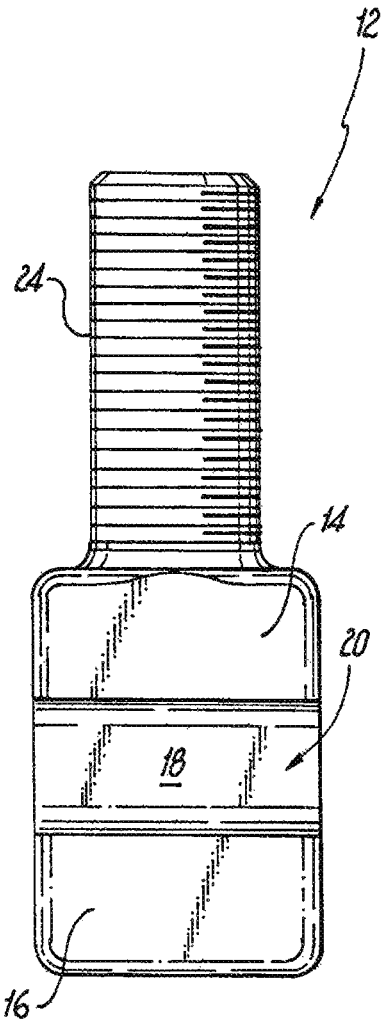
FIG. 6 is a front elevation view of the body of FIG. 5.

Referring to FIGS. 5 and 6, the body 12 has an upper wall 14 and a lower wall 16 joined by a side wall 18 so that a channel 20 is formed there between. The body 12 may be constructed in a number of shapes. As a non-limiting example, the body 12 shown is a U-shaped like structure. However, other body structure shapes, including C-shape like structures are also contemplated by the present disclosure. The upper wall 14 has a contacting surface 14*a* facing the lower wall 16 and the lower wall has a contacting surface 16*a* facing the upper wall. In the exemplary embodiment shown, the upper wall 14 has a substantially flat contacting surface 14*a* facing the lower wall 16, and the lower wall 16 has a contacting surface 16*a* facing the upper wall 14 that has one or more structure gripping members 22, such as for example, teeth, ridges or knurling. In the exemplary embodiment shown, the one or more structure gripping members 22 are teeth. The one or more structure gripping members 22 can be used to facilitate gripping of a metal structure positioned within the channel 20 between the upper and lower walls 14 and 16 and/or to cut through or pierce non-conductive coatings, e.g., oxide, paint and/or anodization, on the metal structure 80, seen in FIGS. 14-16.

Figure 7:
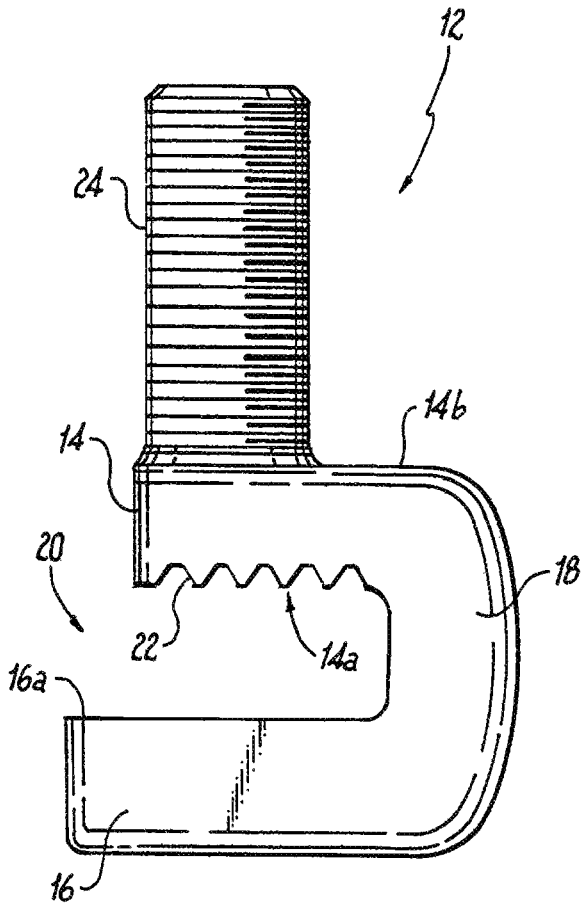
FIG. 7 is a side elevation view of another exemplary embodiment of a body of the bonding connector according to the present disclosure.

Referring to FIG. 7, in another exemplary embodiment the upper wall 14 can have a contacting surface 14*a* that has one or more structure gripping members 22 and the lower wall 16 can have a substantially flat contacting surface 16*a*. As described, the one or more structure gripping members 22 can be used to facilitate gripping of a metal structure 80 positioned within the channel 20 between the upper and lower walls 14 and 16 and/or to cut through or pierce non-conductive coatings on the metal structure 80.

Figure 8:
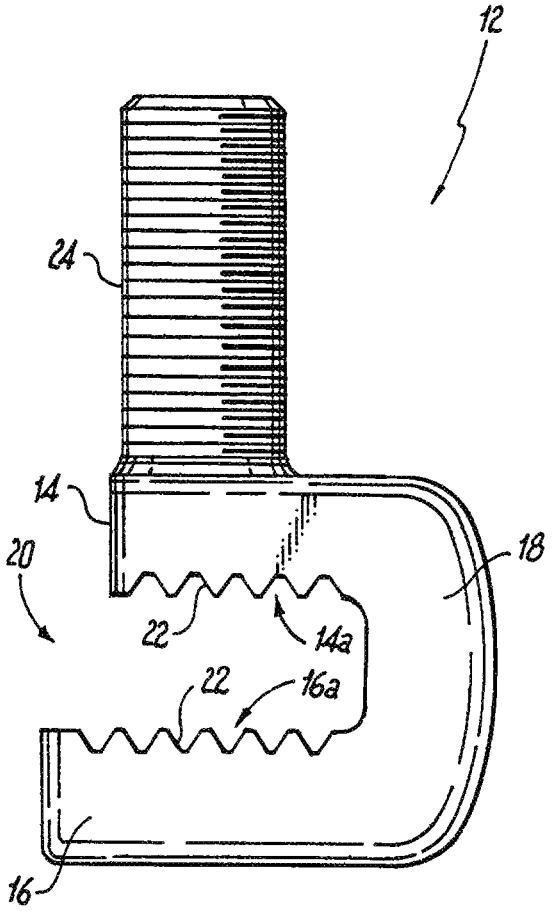
FIG. 8 is a side elevation view of another exemplary embodiment of a body of the bonding connector according to the present disclosure.

Referring to FIG. 8, in another exemplary embodiment the upper wall 14 can have a contacting surface 14*a* that has one or more structure gripping members 22 and the lower wall 16 can have a contacting surface 16*a* that has one or more structure gripping members 22. As described, the one or more structure gripping members 22 can be used to facilitate gripping of a metal structure 80 positioned within the channel 20 between the upper and lower walls 14 and 16 and/or to cut through or pierce non-conductive coatings on the metal structure 80.

Referring again to FIGS. 5 and 6, the upper wall 14 of the body 12 also has a threaded post 24 extending from a top surface 14*b* of the upper wall as shown. The post 24 forms a portion of the fastener assembly and is used to secure a nut 60 to the bonding connector 10. The body 12 of the bonding connector 10 according to the present disclosure is configured, dimensioned and made of a material that provides sufficient structural integrity to secure a metal structure and conductor to the bonding connector while also being capable of providing an electrical conductive path between the conductor and the metal structure so that an electrical current imposed on the metal structure can be conducted to electrical or earth ground. As non-limiting examples, the body 12 can be made of stainless steel or other conductive steel, copper, brass, aluminum and/or an aluminum alloy.

Figure 9:
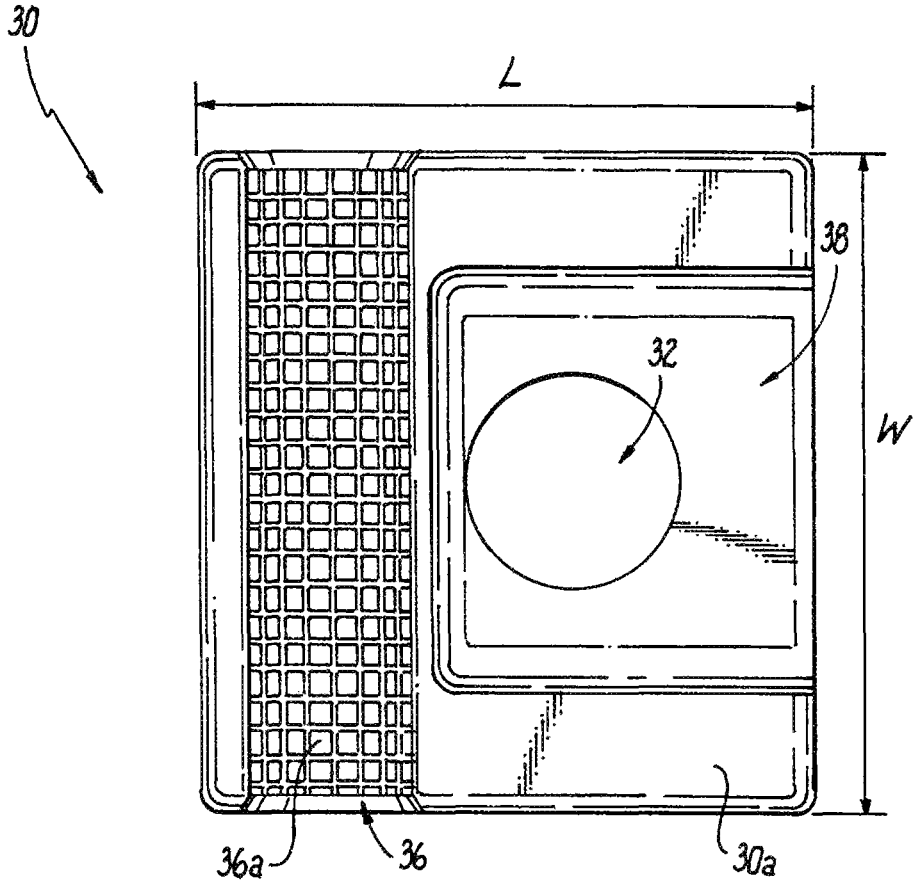
FIG. 9 is a bottom plan view of a cap of the bonding connector of FIG. 1.
Figure 10:
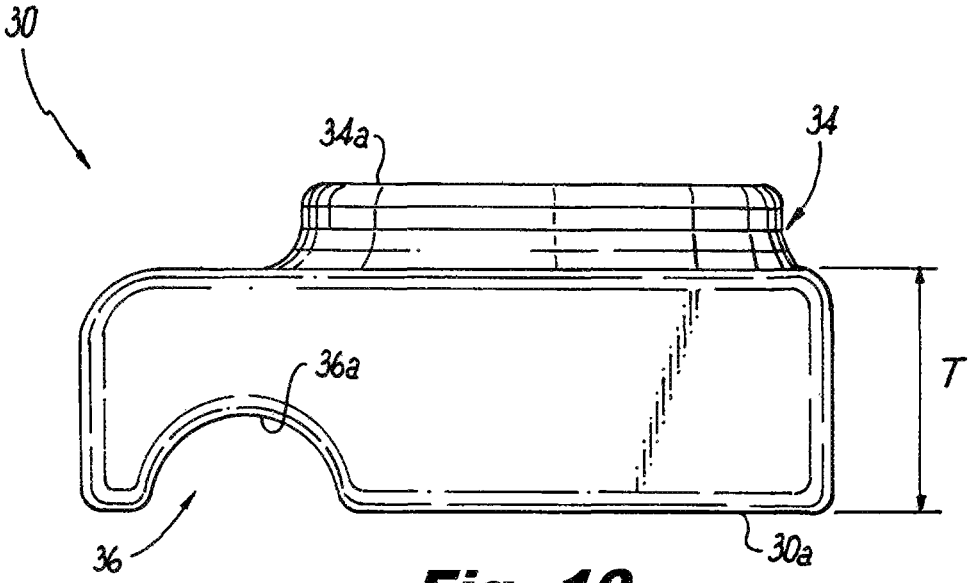
FIG. 10 is a side elevation view of the cap of the bonding connector of FIG. 9.
Figure 11:
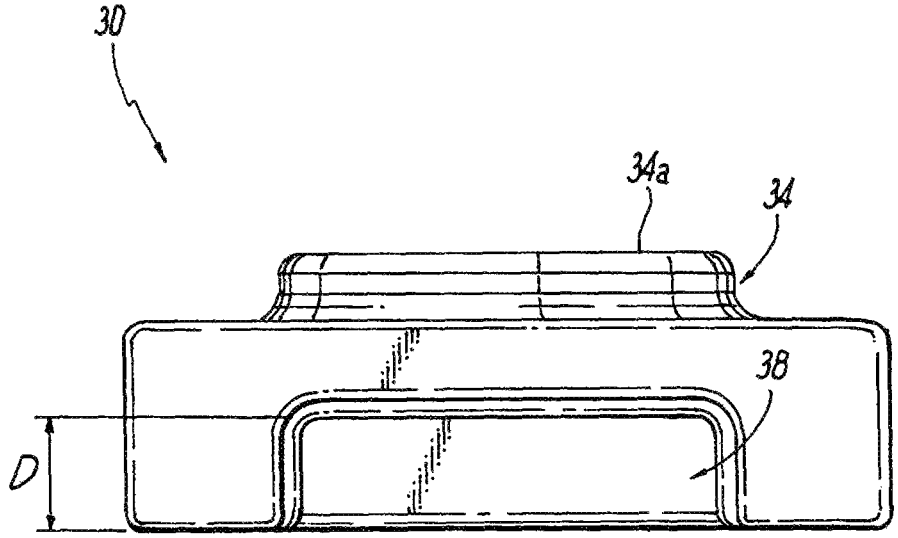
FIG. 11 is a rear elevation view of the cap of the bonding connector of FIG. 9.
Figure 12:
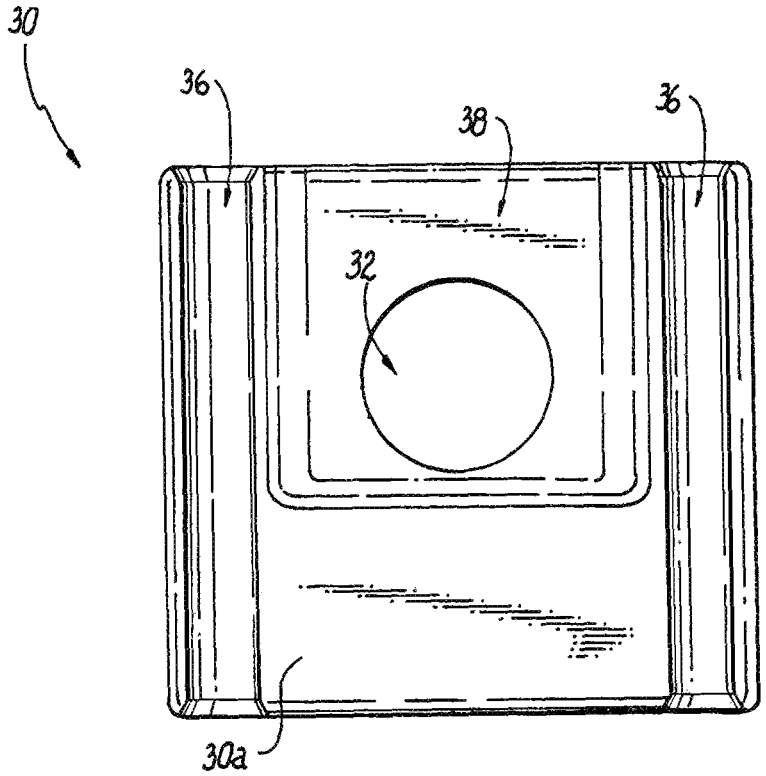
FIG. 12 is a bottom plan view of another exemplary embodiment of a cap of the bonding connector according to the present disclosure.
Figure 13:
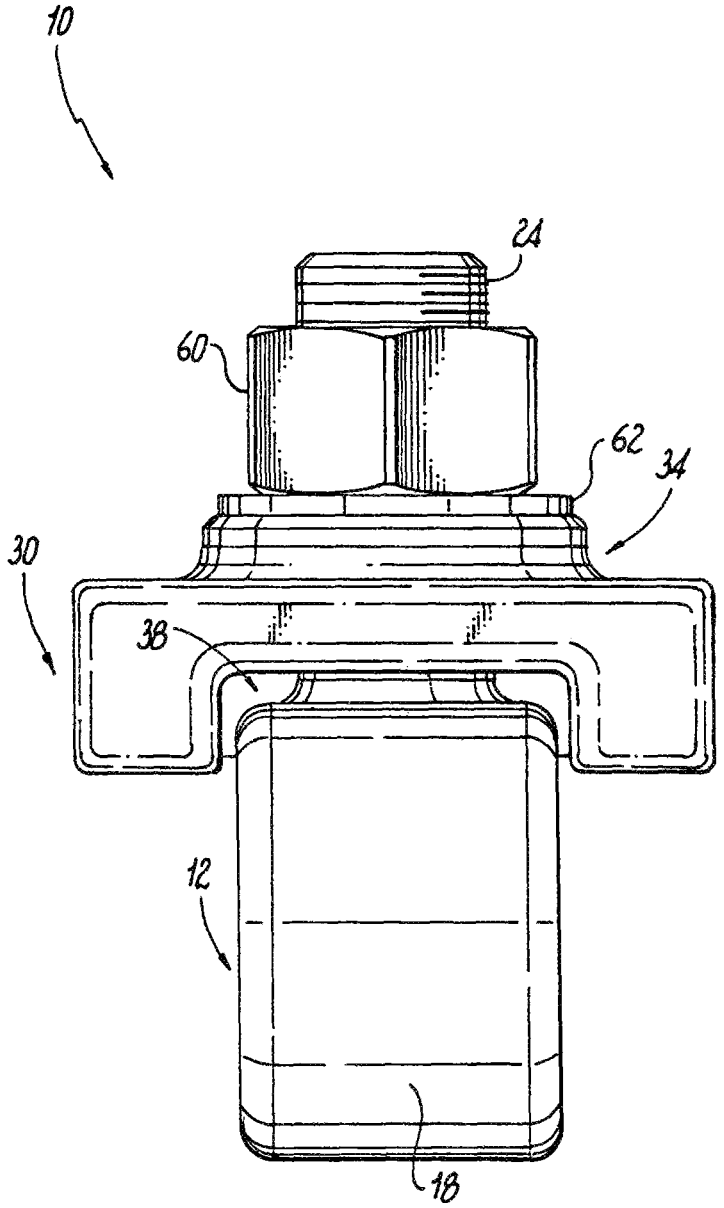
FIG. 13 is a rear elevation view of the bonding connector of FIG. 1.

Referring to FIGS. 9-11, an exemplary embodiment of the cap 30 according to the present disclosure is shown. In this exemplary embodiment, the cap 30 may be constructed in a number of different shapes. As non-limiting examples, the cap 30 may be constructed with a regular shape construction such as a square, round or rectangular shape structure or with an irregular shape construction. In the exemplary embodiment of FIGS. 9-11, the cap 30 is substantially square in shape having a length "L", a width "W" and a thickness "T." The cap 30 includes an aperture 32 for receiving the threaded post 24 extending from the body 12. Surrounding the aperture 32 and either integrally formed into the cap 30 or secured to the cap 30 is a raised surface 34 having a substantially flat upper surface 34*a*. The substantially flat upper surface 34*a* of the raised surface 34 permits the washer 62 and a nut 60, seen in FIG. 4, to sit flush on the raised surface 34. The cap 30 also has one or more conductor channels 36 adjacent the aperture 32 and/or front wall of the cap 30 and through a bottom surface 30*a* of the cap 30. In the embodiment shown, a single conductor channel 36 extends along, for example, the width "W" of the cap 30, as shown in FIG. 10. However, as shown in FIG. 12, one or more conductor channels 36 can extend along, for example, the length "L" of the cap 30. The conductor channel 36 can come in a variety of shapes, but is preferably a semi-circular shaped channel configured and dimensioned to receive an electrical wire. The conductor channel 36 has a conductor contacting surface 36*a* that may include one or more conductor gripping members 22, such as for example, teeth, ridges or knurling, to facilitate gripping of a conductor positioned within the conductor channel 36 and/or to cut through or pierce non-conductive coatings, e.g., oxide, paint and/or anodization, on the conductor. The cap 30 also includes a body receiving channel 38, as seen in FIG. 11, that is configured and dimensioned with a depth "D" to receive at least the upper portion of the body 12 having the post extending there from, as shown in FIG. 13.

The cap 30 is configured, dimensioned and made of a material that provides sufficient structural integrity to secure a metal structure and conductor to the bonding connector 10 while also being capable of providing an electrical conductive path between the conductor and the metal structure so that an electrical current imposed on the metal structure can be conducted to electrical or earth ground. As non-limiting examples, the cap 30 can be made of stainless steel or other conductive steel, copper, brass, aluminum and/or an aluminum alloy.

Figure 14:
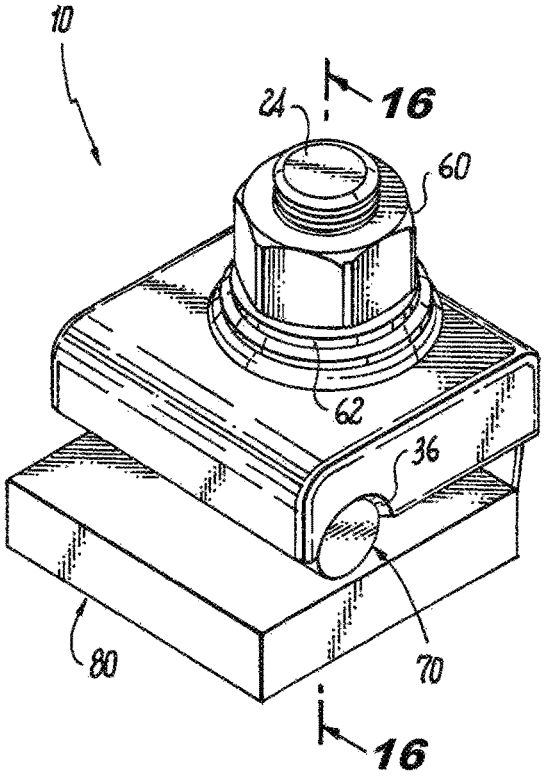
FIG. 14 is a top perspective view of an exemplary embodiment of the bonding connector according to the present disclosure, illustrating an electrical conductor and a metal structure connected to the bonding connector.
Figure 15:
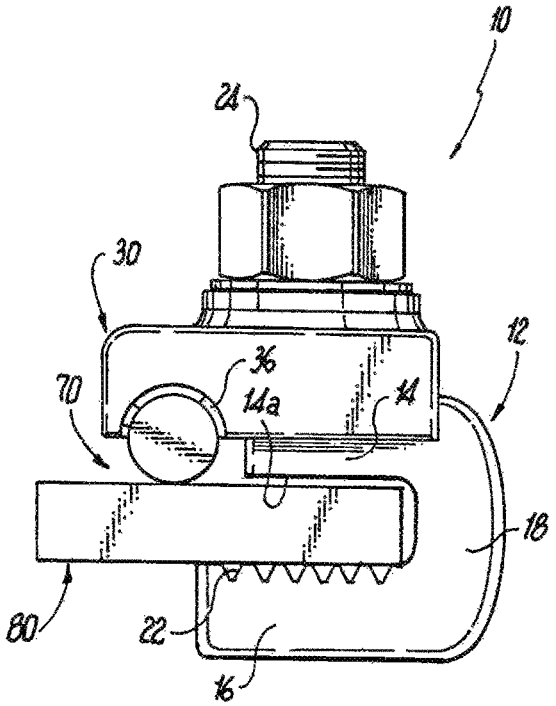
FIG. 15 is a side elevation view of the electrical conductor and metal structure connected to the bonding connector of FIG. 14.
Figure 16:
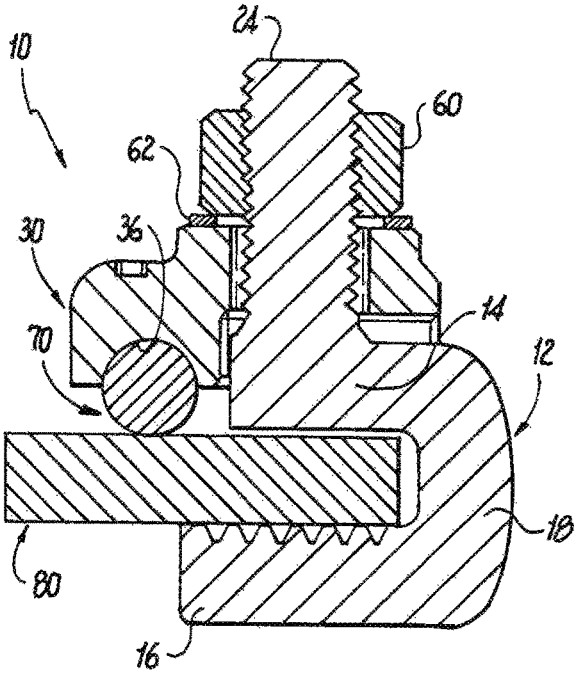
FIG. 16 is a cross-sectional view of the electrical conductor and metal structure connected to the bonding connector of FIG. 14 taken along line 16-16.

Referring to FIGS. 14-16, an exemplary embodiment of an electrical conductor 70 and a metal structure 80 connected to a bonding connector 10 of the present disclosure is shown. The metal structure 80 is positioned within channel 20 between the upper wall 14 and the lower wall 16 such that teeth 22 on the contacting surface 16*a* of the lower wall 16 engage the metal sheet. The conductor 70 is positioned within the conductor channel 36 such that the conductor contacts at least a portion of the metal sheet 80. The washer 62 is inserted over the post 24 extending from the body 12 and through the opening 32 in the cap 30, and the nut 60 is threaded onto the post. The nut is tightened using for example a ratchet and corresponding socket so that the cap 30 is compressed toward the body 12. The compression force exerted by the bonding connector 10 on the conductor 70 and the metal structure 80 firmly secures the bonding connector 10, conductor 70 and metal structure 80 together so that a conductive path is created between the metal structure 80 and the conductor 70 to facilitate bonding the metal structure 80.

While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. A bonding connector comprising:

an electrically conductive body having an upper wall, a lower wall and a side wall connected between the upper wall and the lower wall so as to form a channel between the upper wall and the lower wall, the side wall holding the upper wall in a fixed position relative to the lower wall, and a fastener receiving member extending from the upper wall of the body for receiving a mounting fastener, wherein the upper wall has a first contacting surface facing the lower wall, and wherein the lower wall has a second contacting surface facing the upper wall; and an electrically conductive cap that can be releasably attached to the body, the cap having a conductor receiving channel and an aperture through which the fastener receiving member can pass.

2. The bonding connector according to claim 1, wherein the electrically conductive body is substantially U-shaped.

3. The bonding connector according to claim 1, wherein the electrically conductive body is substantially C-shaped.

4. A bonding connector comprising:

an electrically conductive body having an upper wall and a lower wall connected to the upper wall by a side wall so as to form a channel between the upper wall and the lower wall, and a fastener receiving member extending from the body for receiving a mounting fastener, wherein the upper wall has a first contacting surface facing the lower wall, and wherein the lower wall has a second contacting surface facing the upper wall; and an electrically conductive cap that can be releasably attached to the body, the cap having a conductor receiving channel and an aperture through which the fastener receiving member can pass, wherein the first contacting surface is substantially flat, and wherein the second contacting surface has at least one structure gripping member.

5. The bonding connector according to claim 4, wherein the at least one structure gripping member comprises a single tooth.

6. The bonding connector according to claim 4, wherein the at least one structure gripping member comprises a plurality of teeth.

7. The bonding connector according to claim 4, wherein the at least one structure gripping member comprises a single ridge.

8. The bonding connector according to claim 7, wherein the single ridge is a pointed ridge.

9. The bonding connector according to claim 4, wherein the at least one structure gripping member comprises a plurality of ridges.

10. The bonding connector according to claim 9, wherein the plurality of ridges comprises pointed ridges.

11. A bonding connector comprising:

an electrically conductive body having an upper wall and a lower wall connected to the upper wall by a side wall so as to form a channel between the upper wall and the lower wall, and a fastener receiving member extending from the body for receiving a mounting fastener, wherein the upper wall has a first contacting surface facing the lower wall, and wherein the lower wall has a second contacting surface facing the upper wall; and an electrically conductive cap that can be releasably attached to the body, the cap having a conductor receiving channel and an aperture through which the fastener receiving member can pass, wherein the first contacting surface has at least one structure gripping member, and wherein the second contacting surface is substantially flat.

12. The bonding connector according to claim 11, wherein the at least one structure gripping member comprises a single tooth.

13. The bonding connector according to claim 11, wherein the at least one structure gripping member comprises a plurality of teeth.

14. The bonding connector according to claim 11, wherein the at least one structure gripping member comprises a single ridge.

15. The bonding connector according to claim 14, wherein the single ridge is a pointed ridge.

16. The bonding connector according to claim 11, wherein the at least one structure gripping member comprises a plurality of ridges.

17. The bonding connector according to claim 16, wherein the plurality of ridges comprises pointed ridges.

18. The bonding connector according to claim 1, wherein the first contacting surface has at least one structure gripping member, and wherein the second contacting surface has at least one structure gripping member.

19. The bonding connector according to claim 18, wherein the at least one structure gripping member on the first and second contacting surfaces comprises a single tooth.

20. The bonding connector according to claim 18, wherein the at least one structure gripping member on the first and second contacting surfaces comprises a plurality of teeth.

21. The bonding connector according to claim 18, wherein the at least one structure gripping member on the first and second contacting surfaces comprises a single ridge.

22. The bonding connector according to claim 21, wherein the single ridge is a pointed ridge.

23. The bonding connector according to claim 18, wherein the at least one structure gripping member on the first and second contacting surfaces comprises a plurality of ridges.

24. The bonding connector according to claim 23, wherein the plurality of ridges comprises pointed ridges.

* * * * *